US006723939B2

(12) United States Patent
Hoglund et al.

(10) Patent No.: US 6,723,939 B2
(45) Date of Patent: Apr. 20, 2004

(54) ISOLATION SWITCH FOR ELECTRIC POWER SYSTEMS

(75) Inventors: Justin R. Hoglund, Arden, NC (US); Robert Yanniello, Asheville, NC (US); Joe M. Kellis, Weaverville, NC (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 10/241,122

(22) Filed: Sep. 11, 2002

(65) Prior Publication Data

US 2004/0045937 A1 Mar. 11, 2004

(51) Int. Cl.[7] ..... H01H 33/70
(52) U.S. Cl. ..... 218/78; 218/154; 218/43
(58) Field of Search ..... 218/7, 14, 9, 37, 218/75, 78, 79, 80, 84, 119, 120, 140, 154, 44, 152

(56) References Cited

U.S. PATENT DOCUMENTS 4,300,028 A * 11/1981 Cronin et al. ..... 200/252
4,659,886 A 4/1987 Olsen et al.
5,153,399 A 10/1992 Schaffer et al.
5,484,972 A 1/1996 Tecchio
5,796,060 A * 8/1998 Fuchsle et al. ..... 218/79
5,841,087 A 11/1998 Fuchsle et al.
6,121,566 A * 9/2000 Biquez et al. ..... 218/7
6,545,241 B1 * 4/2003 Franchi et al. ..... 218/78
6,573,469 B1 * 6/2003 Piazza ..... 218/7

* cited by examiner

*Primary Examiner*—Marina Fishman
*Assistant Examiner*—M. Fishman
(74) *Attorney, Agent, or Firm*—Martin J. Jordan

(57) ABSTRACT

The movable conductors of a three-phase isolation switch are incorporated into the electrically insulative molded shaft, thereby mechanically supporting them and isolating them from the metal axle of the shaft. Movable contacts on the ends of each movable conductor are angularly spaced by α degrees, where α is less than 180° and is 90° in the exemplary embodiment. A common fixed load contact is located angularly between, and spaced α degrees from, both the fixed line and ground contacts so that the shaft is rotated only α degrees between a first, closed position, in which the movable conductors connect the fixed load contact for each phase to the corresponding fixed line contact, and a second, grounded position, where the fixed load contact of each phase is connected by the movable conductor to the corresponding fixed ground contact.

14 Claims, 6 Drawing Sheets

ISOLATION SWITCH FOR ELECTRIC POWER SYSTEMS

BACKGROUND OF THE INVENTION

1. Field of the Invention

This invention relates to switches for electric power systems and more particularly to an isolation switch for medium-voltage switchgear.

2. Background Information

Electric power systems include switchgear that distribute power from source buses to load buses and typically provide protection for the load buses. Isolation switches allow the downstream devices to be disconnected from the source bus, such as for maintenance, and provide the capability of connecting the de-energized load bus to ground to protect those working on the system.

A common type of isolation switch has three poles, each including a straight copper conductor mounted for rotation about a transverse axis through the mid point of the conductor with the three pole conductors axially spaced along the common axis of a support shaft. A fixed line contact and a fixed load contact for each pole are positioned in a housing diametrically opposite one another for engagement with the two ends of the movable conductor with the main shaft in a "connected " position to provide electrical continuity between the feeder line and the load bus. A second load contact and a ground contact for each pole are positioned diametrically opposite one another 90° from the diametrically opposite fixed line contact and first load contact for engagement by the two ends of the movable conductor with the shaft in a "grounded" position to connect the load bus to ground. In these typically medium voltage isolation switches, the poles must be sufficiently spaced axially to prevent arcing and multiple fins are provided on the insulative covers on the movable conductors to provide the required creep distance from the ends of the movable conductors to the metal shaft.

There is room for improvement in isolation switches for electric power systems.

SUMMARY OF THE INVENTION

This need and others are satisfied by the invention which is directed to an isolation switch for electric power circuits which includes a housing, a shaft mounted for rotation about its longitudinal axis within the housing and one or more pole units each comprising a movable conductor carried by the shaft and having a first movable contact at one end and a second movable contact at another end. The first and second movable contacts are angularly spaced in a plane perpendicular to the longitudinal axis of the shaft by an angle $\alpha$. The isolation switch in accordance with the invention further includes a fixed load contact, a fixed line contact and a fixed ground contact all mounted in the housing in the plane perpendicular to the main shaft. The fixed load terminal is disposed between and angularly spaced from the fixed line contact and the fixed ground contact by the angle $\alpha$. The shaft is rotatable to a first position in which the first movable contact engages the fixed load contact and the second movable contact engages the fixed line contact, and a second position $\alpha$ degrees from the first position in which the first movable contact engages the fixed ground contact and the second movable contact engages the fixed load contact.

In accordance with another aspect of the invention, the isolation switch comprises a housing, an elongated electrically insulative shaft with a metallic core extending along a longitudinal axis about which the shaft is mounted in the housing for rotation. The isolation switch includes one or more pole units each comprising a movable conductor embedded in and solely supported by the elongated electrically insulative shaft in electrical isolation from the metallic core in a plane substantially perpendicular to the longitudinal axis of the shaft. The shaft is rotatable between a connected position in which the movable conductor connects the load conductor of the electrical system to the line conductor, and a grounded position in which the movable conductor connects the load conductor to the ground conductor.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
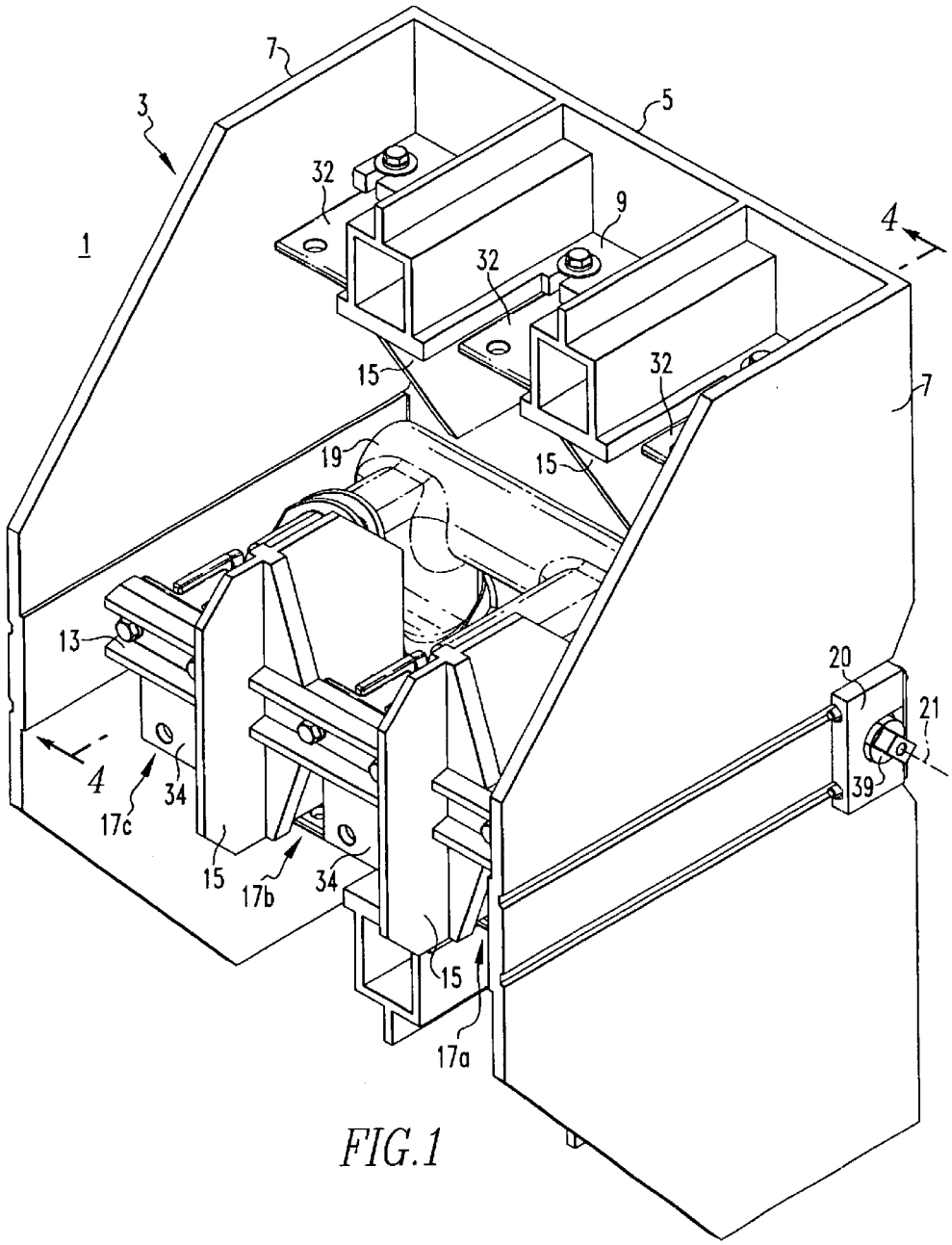
FIG. 1 is an isometric view of an isolation switch in accordance with the invention.
Figure 4:
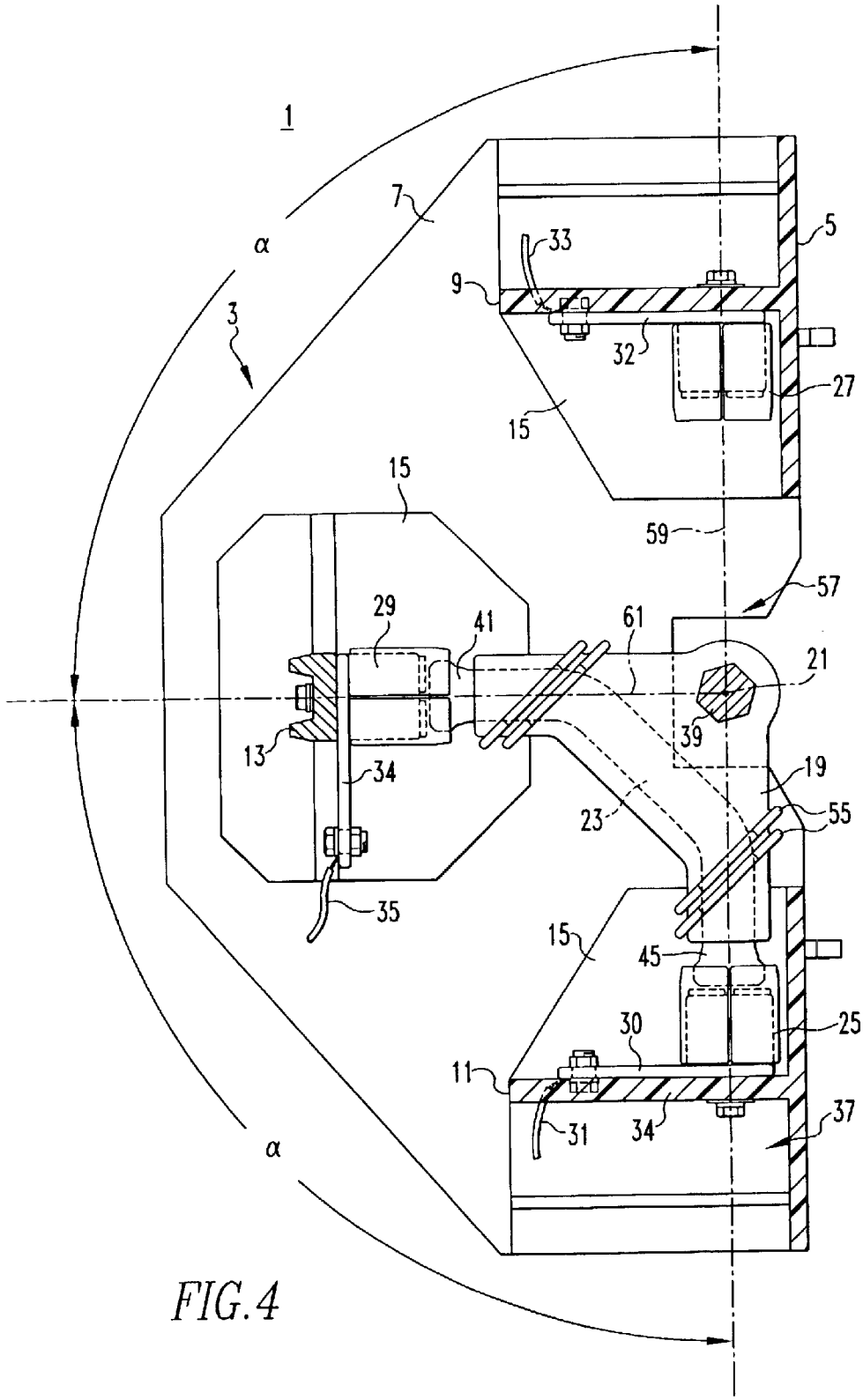
FIG. 4 is a sectional view through one of the poles of the isolation switch shown in the closed position.

FIG. 1 illustrates a three-phase isolation switch 1 in accordance with the invention. The isolation switch 1 has a generally U-shaped housing 3 formed by a base wall 5 and a pair of opposed side walls 7 extending outward from the sides of the base wall. The housing is electrically insulative. Referring to FIG. 4 as well as FIG. 1, a pair of spaced apart integrally molded supports 9 and 11 extend from the base wall 5 between the sidewalls 7. Another support 13 spans the sidewalls 7 near their extremities. Barriers 15 extending transversely from the supports 9, 11 and 13 divide the interior of the housing into three pole compartments 17*a*–17*c*.

A shaft 19 is mounted between bearing blocks 20 on the sidewalls 7 for rotation about a longitudinal axis 21 and thus extends across all three-pole compartments 17*a*–17*c*. Each pole compartment 17*a*–17*c* houses a pole unit which includes a moving conductor 23 carried by the shaft 19, a fixed line contact 25 mounted on the support 11, a fixed ground contact 27 mounted on the support 9, and a fixed load contact 29 mounted on the support 13. The fixed line contact 25, fixed ground contact 27 and fixed load contact 29 are connected through internal conductors 30, 32, and 34 to the line, ground and load conductors 31, 33 and 35, respectively, of an electric power circuit 37.

Figure 2:
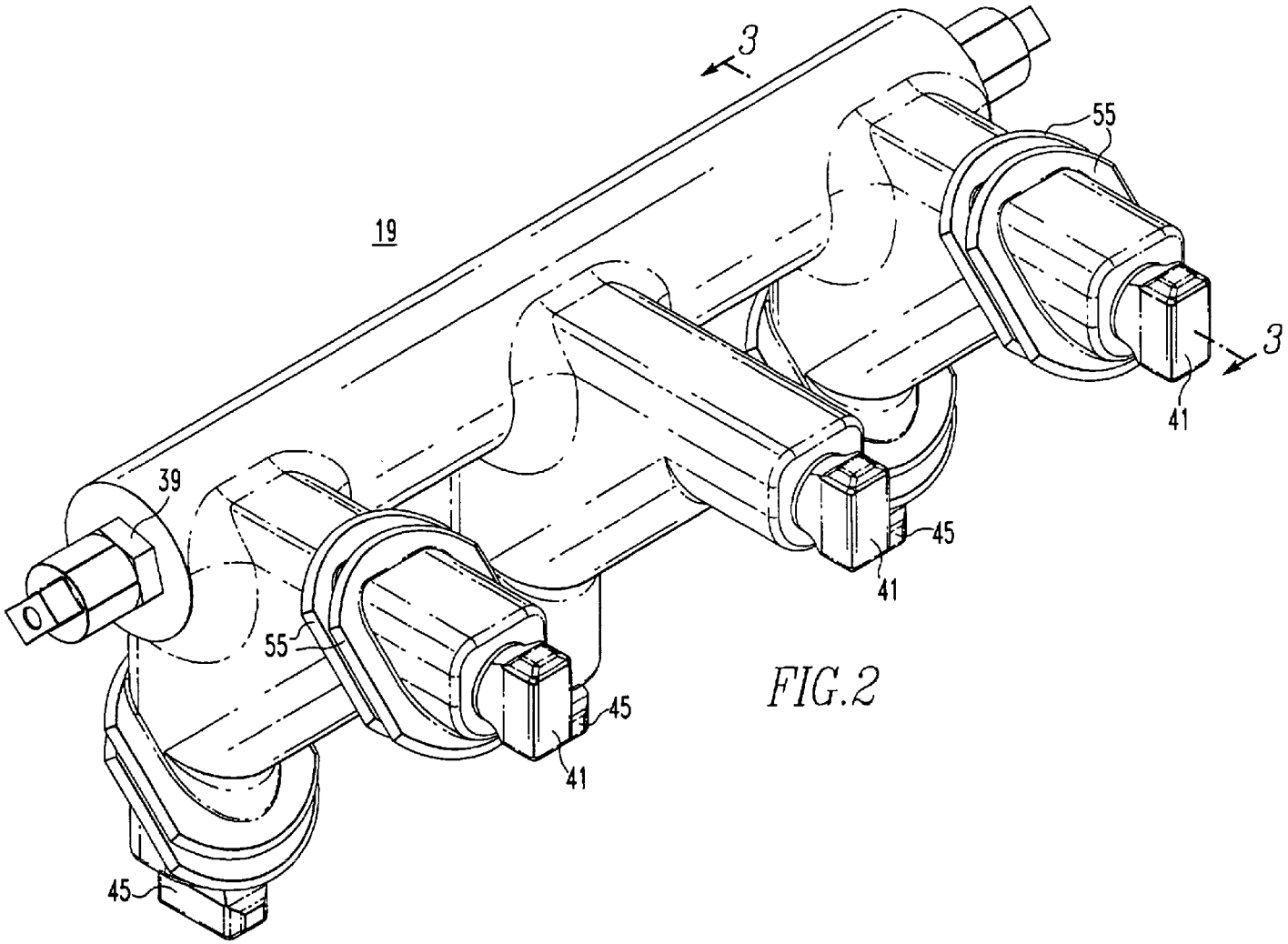
FIG. 2 is an isometric view of the rotatable shaft which forms part of the isolation switch of FIG. 1.
Figure 3:
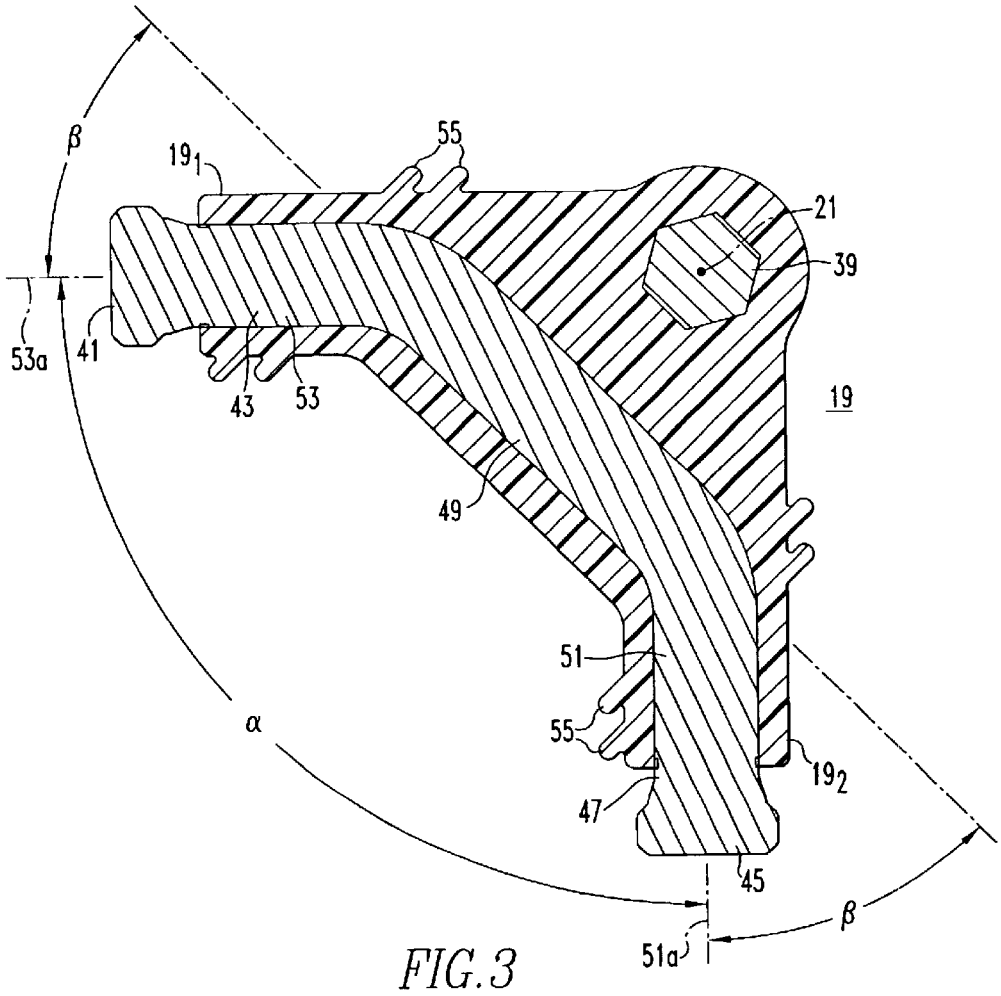
FIG. 3 is a sectional view through the rotatable shaft of FIG. 2 taken through one of the outer poles.

As best seen in FIGS. 2 and 3, the shaft 19 is molded of an electrically insulative material. A steel axle 39, such as a hex bar, is molded into the shaft 19 and extends along the longitudinal axis 21. The moving conductors 23 are molded into the insulating material of the shaft 19 which provides the sole mechanical support for the moving conductors and electrical isolation from the steel axle 39. The molded shaft 19 is generally in the form of an equilateral triangle in cross-section at each pole with the steel axle 39 extending through the apex and with linear extensions $19_1$ and $19_2$ on the other comers. Each moving conductor 23 is a copper bar with a first movable contact 41 at one end 43 and a second movable contact 45 at the other end 47. This movable conductor 23 has a center section 49 which is laterally offset from the steel axle 39, and first and second terminal sections 51 and 53 at the ends 43 and 47. Fins 55 integrally molded on the shaft 19 adjacent the movable contacts 41 and 45 for the outer poles 17*a* and 17*c* increase the creep distance between these movable contacts and the ends of the steel axle 39 that extend beyond the molded body of the shaft 19. These fins are not necessary on the center pole as the molded resin extends fully along the axle 39 between the poles. The movable contacts 41 and 45 on the ends of the moving conductor 23 are angularly spaced in the plane of FIG. 3, which is perpendicular to the longitudinal axis 21 of the shaft 19 by an angle α. This angle α is less than 180°, and in the exemplary embodiment shown, is about 90°. The terminal sections 51 and 53 of the movable conductor form angles β with the center section 49. The angles β are about 45° in the exemplary embodiment.

As can be seen in FIG. 4, the fixed line contact 25, fixed ground contact 27 and fixed load contact 29 are all radially spaced from the longitudinal axis 21 of the shaft 19 by the same distance with the fixed load contact 29 angularly spaced between the fixed line contact 25 and the fixed ground contact 27 each by the angle α which again is less than 180° and in the exemplary embodiment is about 90°. In this exemplary embodiment, the fixed contacts 25, 27 and 29 are disposed in a T configuration 57 having a cross leg 59 and an intersecting leg 61. The fixed line contact 25 and the fixed ground contact 27 are located at opposite ends of the cross leg 59 with the load contact 29 at the free end of the intersecting leg 61. This places the longitudinal axis 21 of the shaft 19 at the intersection of the cross leg 59 and the intersecting leg 61.

Figure 5:
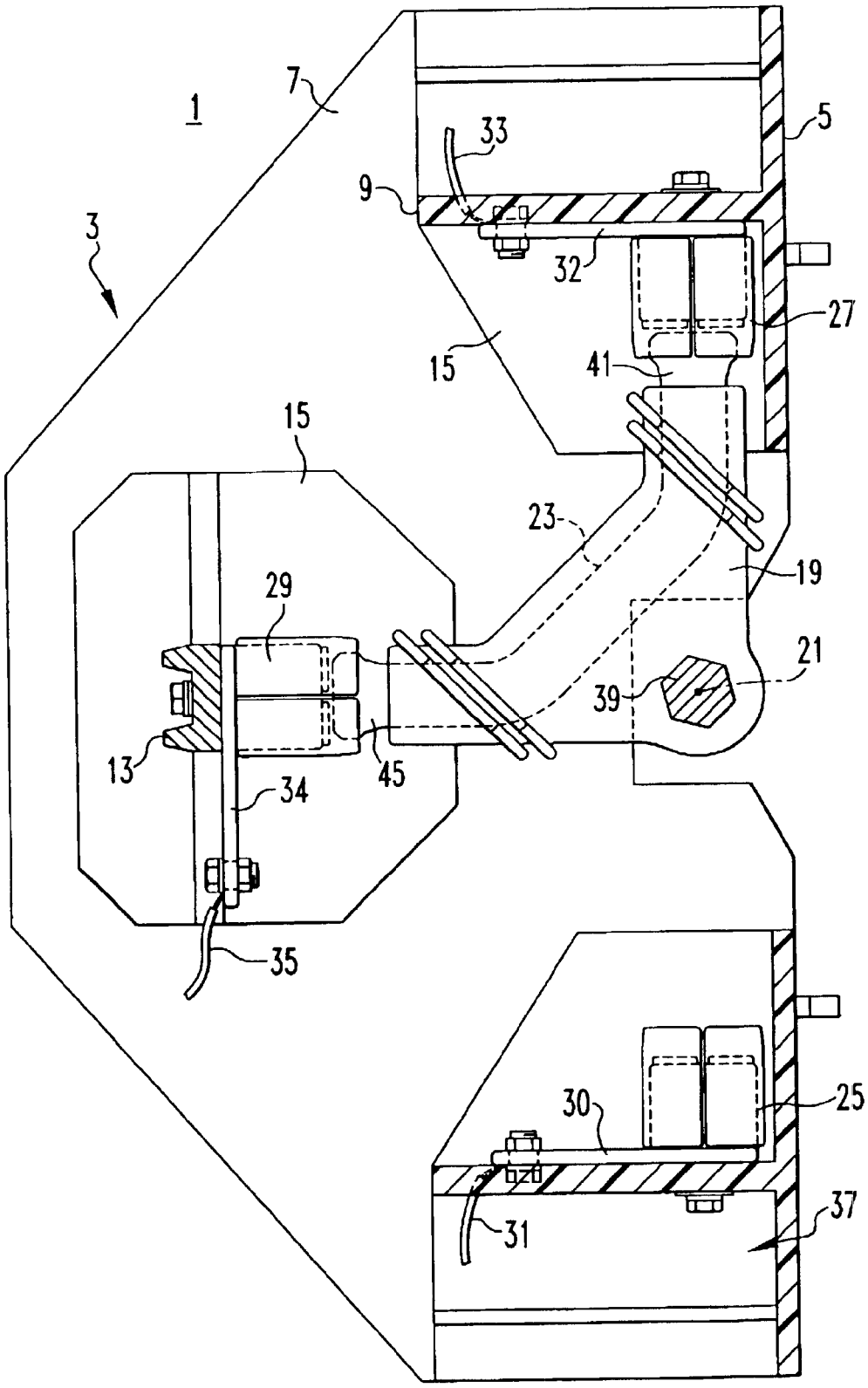
FIG. 5 is a sectional view similar to FIG. 4 showing the switch in the grounded position.

The shaft 19 is rotated about its longitudinal axis 21 manually or by a motor (not shown) coupled to one end of the steel core 39. With the shaft 19 in a first position shown in FIG. 4, the first movable contact 41 engages the fixed load contact 29 and the second movable contact 45 engages the fixed line contact 25. Rotation of the shaft 19 clockwise by the angle α, e.g., 90°, to a second, grounded position shown in FIG. 5 brings the first movable contact 41 into engagement with the fixed ground contact 27 while the second movable contact 45 engages the common fixed load contact 29. Thus, in this second position, the load conductor 35 of the electrical power system 37 is grounded.

Figure 6:
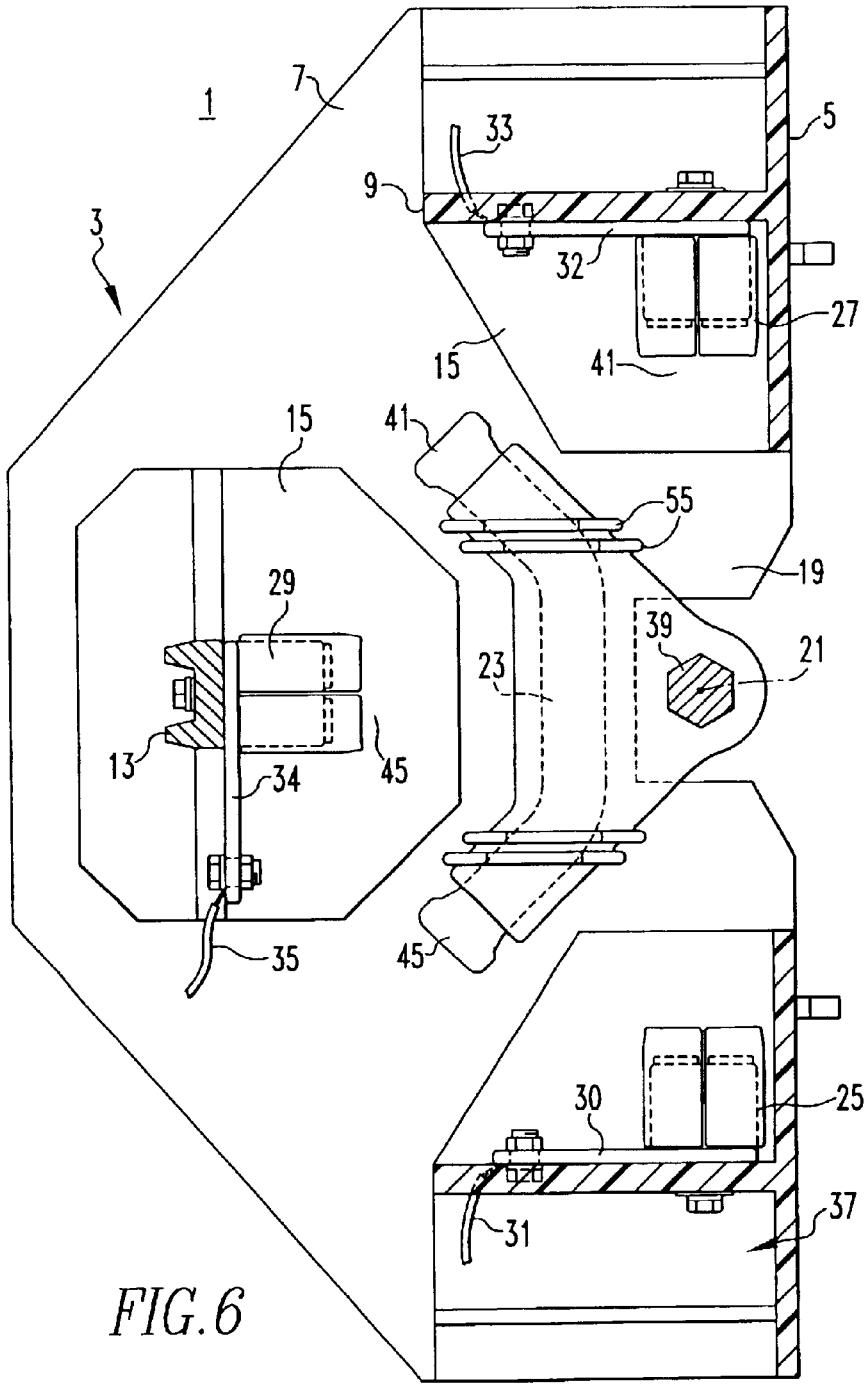
FIG. 6 is a sectional view similar to FIG. 4 showing the switch in the isolated position.

The shaft 19 can be rotated to an intermediate, third position such as shown in FIG. 6 where neither of the movable contacts 41, 45, is connected to the fixed load contact 29 so that the load conductor 35 is isolated.

The above arrangement makes it possible to reduce the physical size of medium voltage three-phase, three-position switch. Only one fixed load contact is required as opposed to the two fixed load contacts required in other isolation switches. In addition, molding the movable conductors into the shaft isolates the phases from one another. This allows a reduction in pole spacing, that is the physical width of the switch. Another advantage of the isolation switch of the invention is that, it reduces the amount of labor required for assembly of the switch as an assembler does not have to assemble the shaft, and therefore, assembly time and shaft variation are reduced.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. An isolation switch for an electric power circuit having a line conductor, load conductor and ground conductor, the isolation switch comprising:

a housing;

a shaft mounted for rotation about its longitudinal axis within the housing;

a pole unit comprising:

a movable conductor carried by the shaft and having a first movable contact at one end and a second movable contact at another end, the first and second movable contacts being angularly spaced in a plane perpendicular to the longitudinal axis of the shaft by an angle α;

a fixed load contact, a fixed line contact, and a fixed ground contact all mounted in the housing in the plane perpendicular to the shaft with the fixed load contact between and angularly spaced from the fixed line contact and the fixed ground contact by the angle α, the shaft being rotatable to a first position in which the first movable contact engages the fixed load contact and the second movable contact engages the fixed line contact, and a second position α degrees from the first position in which the first movable contact engages the fixed ground contact and the second movable contact engages the fixed load contact; and wherein the shaft has a metal axle extending along the longitudinal axis and the pole unit includes an insulative material mechanically mounting the movable conductor on an providing electrical isolation from the metal axle.

2. The isolation switch of claim 1, wherein the shaft is rotatable to a third position in which neither of the first and second movable contacts engages the fixed load contact.

3. The isolation switch of claim 1, wherein the angle α is less than 180°.

4. The isolation switch of claim 3, wherein the angle α is about 90°.

5. The isolation switch of claim 1 comprising multiple pole units axially spaced along the shaft.

6. The isolation switch of claim 5, wherein there are three pole units.

7. The isolation switch of claim 1 comprising multiple pole units and the insulative material extending along the metal axle between the axially spaced pole units to form a single continuous element integral with the insulative material at the pole units.

8. The isolation switch of claim 7, wherein the insulative material forms integral fins adjacent the first and second movable contacts on outer pole units.

9. The isolation switch of claim 1, wherein the angle α is about 90° and the movable conductor comprises a copper bar having a center section and terminal sections at the one end and another end of the copper bar and forming about 45° angles with the center section.

10. The isolation switch of claim 9, wherein projections of longitudinal axis of the terminal sections of the movable conductor intersect at the longitudinal axis of the shaft.

11. The isolation switch of claim 10, wherein the fixed line contact, fixed ground contact and fixed load contact are disposed in a T configuration having a cross leg and an intersecting leg intersecting the cross leg, the fixed line contact and the fixed ground contact being disposed at opposite ends of the cross leg and the fixed load contact being disposed at a free end of the intersecting leg, and the longitudinal axis of the shaft being disposed at the intersection of the intersecting leg with the cross leg.

12. An isolation switch for an electrical power circuit having a line conductor, a load conductor and a ground conductor, the isolation switch comprising:

a housing;

an elongated electrically insulative shaft with a metal axle extending along a longitudinal axis about which the shaft is mounted in the housing for rotation; and a pole unit comprising a movable conductor embedded and solely supported by the elongated electrically insulative shaft in electrical isolation from the metal axle, the shaft being rotatable between a connected position in which the movable conductor connects the load conductor to the line conductor, and a grounded position in which the movable conductor connects the load connector to the ground conductor.

13. The isolation switch of claim 12 comprising multiple pole units mounted axially on the shaft.

14. The isolation switch of claim 13, wherein the movable conductor has terminal sections angularly spaced from each other by an angle $\alpha$ and each extending substantially radially outward from the longitudinal axis of the shaft and a center section joining the terminal sections and offset laterally from the metal axle.

* * * * *